US010199743B2

(12) United States Patent
Cheng et al.

(10) Patent No.: US 10,199,743 B2
(45) Date of Patent: Feb. 5, 2019

(54) ARRAY ANTENNA

(71) Applicant: HUAWEI TECHNOLOGIES CO., LTD., Shenzhen (CN)

(72) Inventors: Yujian Cheng, Chengdu (CN); Yi Chen, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 148 days.

(21) Appl. No.: 15/261,006

(22) Filed: Sep. 9, 2016

(65) Prior Publication Data

US 2016/0380362 A1 Dec. 29, 2016

Related U.S. Application Data

(63) Continuation of application No. PCT/CN2014/073269, filed on Mar. 12, 2014.

(51) Int. Cl.
*H01Q 21/00* (2006.01)
*H01Q 21/06* (2006.01)

(52) U.S. Cl.
CPC ..... *H01Q 21/065* (2013.01); *H01Q 21/0006* (2013.01); *H01Q 21/0087* (2013.01); *H01Q 21/0093* (2013.01); *H01Q 21/062* (2013.01)

(58) Field of Classification Search
CPC ..... H01Q 21/0006; H01Q 21/0037; H01Q 21/0043; H01Q 21/005; H01Q 21/06; H01Q 21/061; H01Q 21/062; H01Q 21/065
See application file for complete search history.

(56) References Cited

U.S. PATENT DOCUMENTS 6,064,350 A 5/2000 Uchimura et al.
7,808,439 B2 * 10/2010 Yang ..... H01P 3/121 343/770
(Continued)

FOREIGN PATENT DOCUMENTS

CN 1885616 12/2006
CN 1885616 A 12/2006
(Continued)

OTHER PUBLICATIONS

Extended European Search Report dated Feb. 1, 2017 in corresponding European Patent Application No. 14885247.8.
(Continued)

*Primary Examiner* — Tho G Phan
*Assistant Examiner* — Patrick Holecek
(74) *Attorney, Agent, or Firm* — Staas & Halsey LLP

(57) ABSTRACT

An array antenna includes a first metal layer, a first dielectric layer, a second metal layer, a second dielectric layer, and a third metal layer that are sequentially laminated, where multiple metal through holes are disposed on the second dielectric layer, the multiple metal through holes form a feeding section, the first metal layer includes multiple subarrays, each subarray includes multiple radiating arrays and one power splitter, the power splitter includes a central area and multiple branches extending from the central area, the multiple radiating arrays are respectively connected to ends of the multiple braches that are far from the central area, multiple coupling slots are disposed on the second metal layer, the multiple coupling slots respectively face central areas, the feeding section is used to feed a signal.

13 Claims, 6 Drawing Sheets

(56) References Cited

U.S. PATENT DOCUMENTS

| | | | | |
|---|---|---|---|---|
| 8,558,746 | B2 * | 10/2013 | Thomson | H01Q 21/0075 29/600 |
| 2006/0097926 | A1 | 5/2006 | Fujii et al. | |
| 2011/0133991 | A1 | 6/2011 | Lee et al. | |
| 2011/0267152 | A1 | 11/2011 | Lee | |

FOREIGN PATENT DOCUMENTS

| | | |
|---|---|---|
| CN | 102110902 | 6/2011 |
| CN | 102110902 A | 6/2011 |
| CN | 103268981 | 8/2013 |
| CN | 103268981 A | 8/2013 |

OTHER PUBLICATIONS

International Search Report and Written Opinion dated Nov. 18, 2014 in corresponding International Patent Application No. PCT/CN2014/073269.

Chinese Office Action dated Jan. 25, 2017 in corresponding Chinese Patent Application No. 201480000131.8.

Chinese Search Report dated Jan. 19, 2017 in corresponding Chinese Patent Application No. 2014800001318.

Junfeng Xu et al., "Bandwidth Enhancement for a 60 GHz Substrate Integrated Waveguide Fed Cavity Array on LTCC", IEEE Transactions on Antennas and Propagation, vol. 59, No. 3, IEEE, Mar. 2011, pp. 826-832.

Nasser Ghassemi et al., "High-Efficient Patch Antenna Array for E-Band Gigabyte Point-to-Point Wireless Services", IEEE Antennas and Wireless Propagation Letters, vol. 11, IEEE, 2012, pp. 1261-1264.

Nasser Ghassemi et al., "Low-Cost and High-Efficient W-Band Substrate Integrated Waveguide Antenna Array Made of Printed Circuit Board Process", IEEE Transactions on Antennas and Propagation, vol. 60, No. 3, IEEE, Mar. 2012, pp. 1648-1653.

International Search Report dated Nov. 18, 2014 in corresponding International Application No. PCT/CN2014/073269.

* cited by examiner

ARRAY ANTENNA

CROSS-REFERENCE TO RELATED APPLICATIONS

This application is a continuation of International Application No. PCT/CN2014/073269, filed on Mar. 12, 2014, which is hereby incorporated by reference in its entirety.

TECHNICAL FIELD

The present invention relates to the communications field, and in particular, to an array antenna.

BACKGROUND

An antenna is one of most important front-end passive components of a communications device. The antenna has a very important role in performance of a communications product. An array antenna basically includes two parts: a feeding network and an antenna element array. It is generally required that signals output by the feeding network to all antenna elements are equal in amplitude and identical in phase with a small feeder loss, and a distance between two antenna elements is a half of an operating wavelength with high radiation efficiency.

A feeding network of an existing array antenna may be generally implemented in several manners, such as using a microstrip, a waveguide, and a substrate-integrated waveguide. It is easy for a microstrip feeding network to meet the requirement for equal amplitude and an identical phase by using a parallel feeding structure design, but a microstrip line has a large loss at a high frequency and has poor performance. The waveguide has a minimum transmission loss, but generally only a serial feeding manner can be used due to a large waveguide size; therefore, the requirement for equal amplitude and an identical phase can be met only within a narrow frequency range. If a parallel feeding manner is used, due to a waveguide width limitation, it is not easy to meet the requirement that a distance between antenna elements is a half of an operating wavelength. The substrate-integrated waveguide has a small loss and is easier to be processed and integrated than the waveguide, but the substrate-integrated waveguide has a same problem as the waveguide, that is, the requirement that a distance between antenna elements is a half of an operating wavelength cannot be met due to the width limitation.

Therefore, the array antenna in the prior art has disadvantages of a large loss at a high frequency, poor performance, and narrow bandwidth.

SUMMARY

Embodiments of the present invention provide an array antenna, to increase bandwidth of an antenna, and meet a requirement of a system that requires relatively broad bandwidth.

An embodiment of the present invention provides an array antenna, including a first metal layer, a first dielectric layer, a second metal layer, a second dielectric layer and a third metal layer that are sequentially laminated, where multiple metal through holes are disposed on the second dielectric layer, the multiple metal through holes are electrically connected between the second metal layer and the third metal layer, and form a feeding section, the first metal layer includes multiple subarrays, each subarray includes multiple radiating arrays and one power splitter, the power splitter includes a central area and multiple branches extending from the central area, the multiple radiating arrays are respectively connected to ends of the multiple branches that are far from the central area to form a parallel signal transmission architecture, multiple coupling slots are disposed on the second metal layer, the multiple coupling slots respectively face central areas of multiple power splitters, the feeding section is used to feed a signal, the signal is transmitted to the central areas of the power splitters by using the multiple coupling slots, and the signal is transmitted to the multiple radiating arrays by using the multiple branches.

In a first possible implementation manner, the feeding section includes multiple feeding units, and projections of the multiple coupling slots on the second dielectric layer respectively fall within ranges of the multiple feeding units.

With reference to the first possible implementation manner, in a second possible implementation manner, each of the feeding units includes a central line, metal through holes forming the feeding unit are symmetrically distributed on two sides of the central line, and the multiple coupling slots deviate from central lines of the corresponding feeding units with reference to the first possible implementation manner, in a third possible implementation manner, each of the feeding units includes a pair of transmission portions and a short-circuit end, where the short-circuit end is connected between the pair of transmission portions and is located on one end of the pair of transmission portions, an open end is located on one end of the pair of transmission portions that is far from the short-circuit end, each two of the multiple feeding units are opposite to each other, and open ends of the two feeding units that are opposite to each other are adjacent to each other.

With reference to the third possible implementation manner, in a fourth possible implementation manner, the transmission portions are parallel to each other.

With reference to the third possible implementation manner, in a fifth possible implementation manner, the feeding section further includes a T-shaped power splitter, where the T-shaped power splitter is located between two adjacent feeding units, and is close to open ends of the feeding units.

With reference to the fifth possible implementation manner, in a sixth possible implementation manner, each T-shaped power splitter is formed by three metal through holes that are triangularly arranged.

With reference to any one of the foregoing possible implementation manners, in a seventh possible implementation manner, the multiple branches are symmetrically distributed on two sides of the central area, and the radiating arrays are symmetrically distributed on two sides of the power splitter.

With reference to any one of the foregoing possible implementation manners, in an eighth possible implementation manner, the first dielectric layer and the first metal layer form a radiating dielectric substrate of the array antenna, the second metal layer, the second dielectric layer and the third metal layer together form a feeding dielectric substrate of the array antenna, and thicknesses and dielectric constants of the radiating dielectric substrate and the feeding dielectric substrate are different.

With reference to any one of the foregoing possible implementation manners, in a ninth possible implementation manner, the radiating dielectric substrate and the feeding dielectric substrate overlap, the thickness of the radiating dielectric substrate is 0.254 mm, and the thickness of the feeding dielectric substrate is 0.508 mm.

With reference to any one of the foregoing possible implementation manners, in a tenth possible implementation manner, the multiple coupling slots are rectangular, and the multiple metal through holes are circular.

With reference to any one of the foregoing possible implementation manners, in an eleventh possible implementation manner, the power splitter is a microstrip splitter.

With reference to any one of the foregoing possible implementation manners, in a twelfth possible implementation manner, the multiple metal through holes run through the second metal layer, the second dielectric layer and the third metal layer.

Compared with the prior art, by means of a parallel transmission architecture formed by multiple radiating arrays and a microstrip splitter of a subarray, bandwidth of an antenna is increased, and a high-gain compact-broadband planar millimeter wave array antenna is provided.

BRIEF DESCRIPTION OF DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and persons of ordinary skill in the art may still derive other drawings from these accompanying drawings without creative efforts.

DESCRIPTION OF EMBODIMENTS

Figure 1:
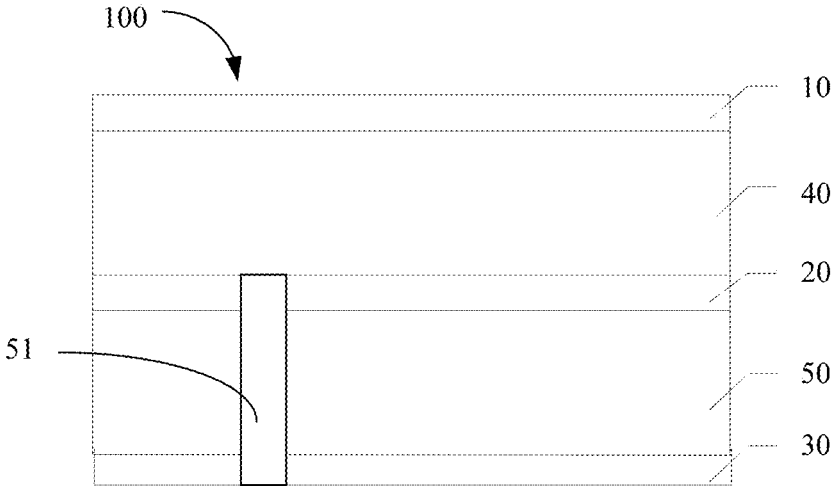
FIG. 1 is a schematic diagram of an array antenna according to an implementation manner of the present invention.
Figure 2:
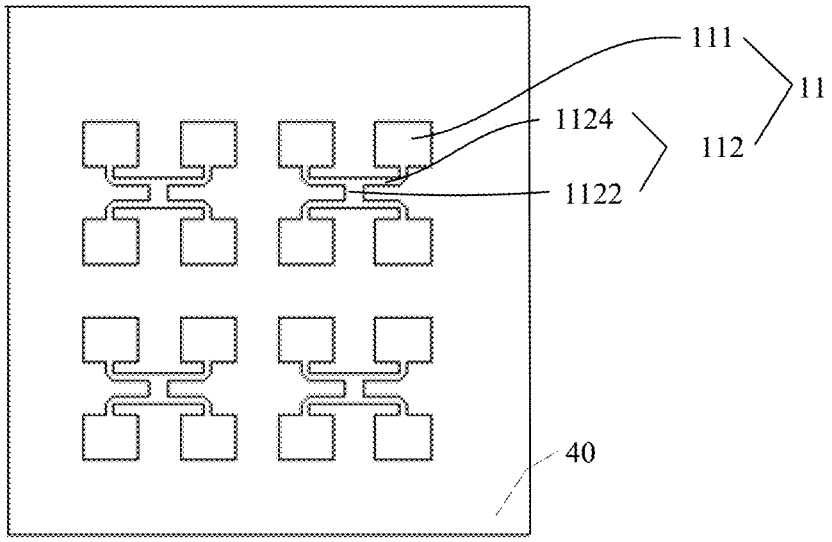
FIG. 2 is a schematic diagram of arrangement of subarrays of an array antenna according to an implementation manner of the present invention.

The following clearly describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

Referring to FIG. 1, FIG. 2, FIG. 3, and FIG. 5, an array antenna 100 provided in an implementation manner of the present invention includes a first metal layer 10, a first dielectric layer 40, a second metal layer 20, a second dielectric layer 50 and a third metal layer 30 that are sequentially laminated, where multiple metal through holes 51 are disposed on the second dielectric layer 50, the multiple metal through holes 51 are electrically connected between the second metal layer 20 and the third metal layer 30, and form a feeding section 52. In an implementation manner, the multiple metal through holes 51 run through the second metal layer 20, the second dielectric layer 50 and the third metal layer 30, and form the feeding section 52. In another implementation manner, the multiple metal through holes 51 may also be embedded in the second dielectric layer 50, and electrically connected to the second metal layer 20 and the third metal layer 30 in a physical connection manner. The first metal layer 10 includes multiple subarrays 11, each subarray 11 includes multiple radiating arrays 111 and one power splitter 112, the power splitter 112 includes a central area 1122 and multiple branches 1124 extending from the central area, and the multiple radiating arrays 111 are respectively connected to ends of the multiple branches 1124 that are far from the central area 1122 to form a parallel signal transmission architecture. Multiple coupling slots 21 are disposed on the second metal layer 20, and the multiple coupling slots 21 respectively face central areas 1122 of the multiple power splitters 112. The feeding section 52 is used to feed a signal, the signal is transmitted to the central areas 1122 of the power splitters 112 by using the multiple coupling slots 21, and the signal is transmitted to the multiple radiating arrays 111 by using the multiple branches 1124.

In the present invention, by using the parallel transmission architecture formed by the multiple radiating arrays 111 and the power splitter 112 of the subarray 11, bandwidth of the array antenna 100 is increased, and a high-gain compact-broadband planar millimeter wave array antenna 100 is provided.

Figure 8:
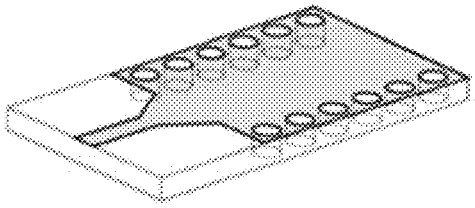
FIG. 8 to FIG. 10 are three different feeding architectures of a feeding section of an array antenna according to the present invention.
Figure 9:
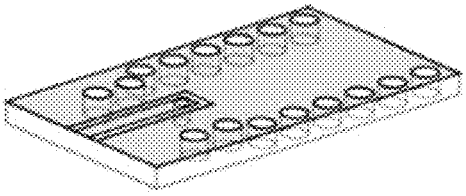
Figure 10:
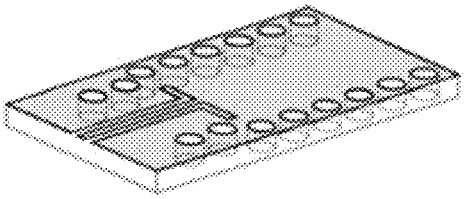

Specifically, the multiple metal through holes 51 are disposed on the second dielectric layer 50, and the multiple metal through holes 51 form the feeding section 52 together. In the present invention, a transmission line structure having a small loss is used to feed the array antenna 100, and there are multiple signal feeding manners for the feeding section 52 of the array antenna 100 in the present invention, which mainly depends on a transmission line design of a circuit connected to the array antenna 100. For example, a transmission line of the feeding section 52 is a substrate-integrated waveguide, and there are multiple transmission line conversion manners that can connect the substrate-integrated waveguide to a transmission line, such as a waveguide, a microstrip, and a coplanar waveguide, to implement signal feeding for the array antenna 100. Referring to FIG. 8 to FIG. 10, three feeding architectures of the feeding section 52 are illustrated by using an example. FIG. 8 is a tapered transition structure. FIG. 9 is a probe transition structure. FIG. 10 is a coplanar waveguide transition structure based on a substrate-integrated waveguide (SIW).

The multiple subarrays 11 in the present invention are distributed in the first metal layer 10 covering a surface of the first dielectric layer 40. In a manufacturing process, a circuit structure of the multiple subarrays 11 is formed by using a method, such as etching the first metal layer 10. The subarray 11 in the present invention is a surface mount array of a planar structure, and is formed by a microstrip. The present invention can ensure a planar structure, and also implement highly efficient feeding and radiation.

The array antenna 100 provided in the present invention implements feeding and radiation in a shunt-fed manner, and in large array application, it can be ensured that a broadband property of the array antenna is not changed. Because the array antenna 100 provided in the present invention uses parallel feeding, which ensures that paths from a feed port to all the subarrays 11 are consistent, even though a signal frequency changes, phases of signals reaching the subarrays 11 are still consistent, so that performance of the array antenna 100 is kept, and a contradiction between broadband work and a requirement for a high gain is resolved.

In a specific manufacturing process, the array antenna 100 is processed by using a standard multilayer circuit board manufacturing technology, which facilitates mass production and has high reliability and a high repetition rate. The first metal layer 10, the first dielectric layer 40 and the second metal layer 20 are considered as a first substrate with two sides coated with copper, the second metal layer 20, the second dielectric layer 50 and the third metal layer 30 are considered as a second substrate with two sides coated with copper, and after laminated, the first substrate and the second substrate form an architecture in which the first metal layer 10, the first dielectric layer 40, the second metal layer 20, the second dielectric layer 50, and the third metal layer 30 are sequentially laminated. In a laminating process, the second metal layer of the first substrate and the second metal layer of the second substrate overlap and are press-fitted into one layer. The feeding section 52 of the array antenna in the present invention is right under the subarrays 11, which implements array miniaturization and reduces space.

The multiple subarrays 11 in the present invention are 2×2 arrays. In another implementation manner, the multiple subarrays 11 may also be N×N arrays, where N is a natural number.

Figure 3:
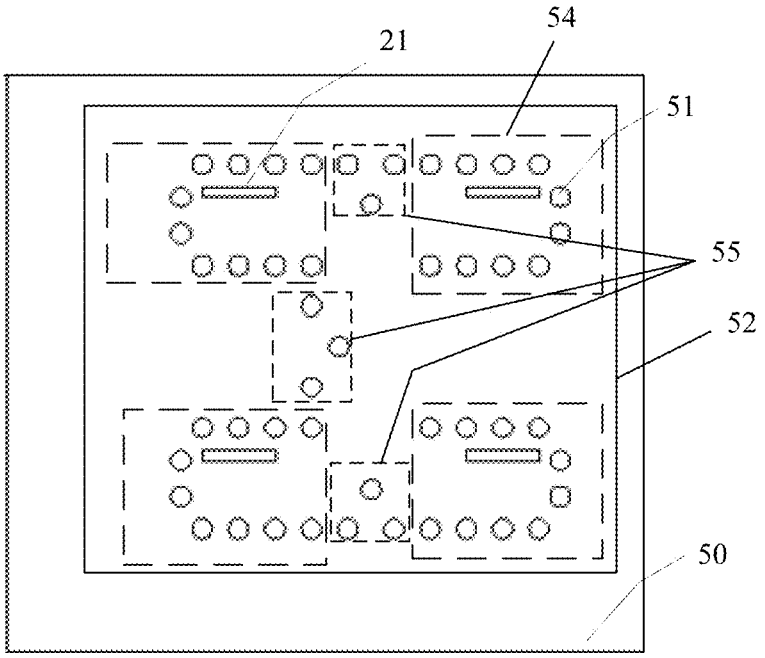
FIG. 3 is a schematic diagram of distribution of feeding sections and coupling slots of an array antenna according to an implementation manner of the present invention.

Referring to FIG. 3, the feeding section 52 includes multiple feeding units 54, and projections of the multiple coupling slots 21 on the second dielectric layer 50 respectively fall within ranges of the multiple feeding units 54. In this implementation manner, the multiple coupling slots 21 are perpendicular to the second metal layer 20 and the second dielectric layer 50.

Figure 4:
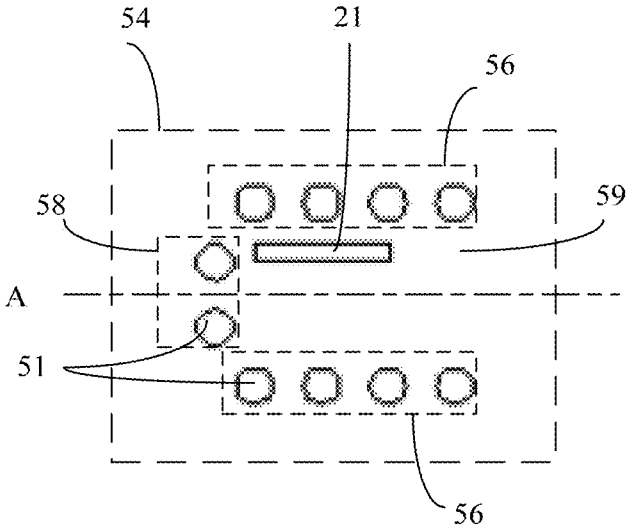
FIG. 4 is a schematic diagram of distribution of a feeding unit and a coupling slot in a feeding section of an array antenna according to an implementation manner of the present invention.
Figure 5:
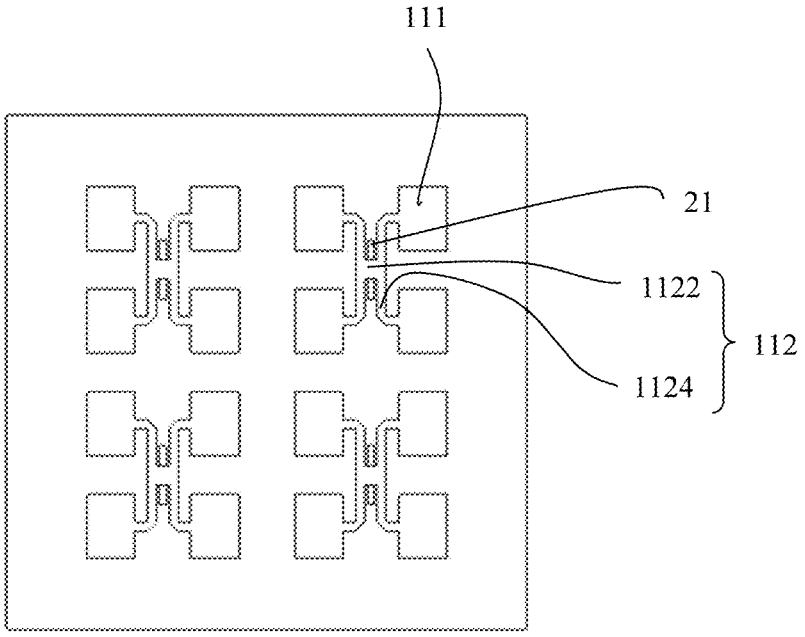
FIG. 5 is a schematic diagram of distribution of subarrays and coupling slots of an array antenna according to an implementation manner of the present invention.

Referring to FIG. 4, each of the feeding units 54 is of a mirror symmetric structure, metal through holes 51 forming the feeding unit 54 are symmetrically distributed on two sides of a central line A of the feeding unit 54, and the multiple coupling slots 21 deviate from central lines A of the corresponding feeding units 54, to split a surface current. Electromagnetic waves of the feeding section 52 are coupled to the central areas 1122 of the power splitters 112 by using the coupling slots 21. The branches 1124 and the central area 1122 of the power splitter 112 form a transmission structure distributed back to back, and the multiple branches 1124 are symmetrically distributed on two sides of the central area 1122. Because the coupling slots 21 and the central areas 1122 overlap, directions of electric fields on branches 1124 that are symmetric relative to the coupling slots 21 are reverse.

Each of the feeding units 54 includes a pair of transmission portions 56, a short-circuit end 58, and an open end 59, where the short-circuit end 58 is connected between the pair of transmission portions 56 and is located on one end of the pair of transmission portions 56, the open end 59 is located on one side of the transmission portions 56 that is far from the short-circuit end 58, each two of the multiple feeding units 54 are opposite to each other, and open ends 59 of the two feeding units 54 that are opposite to each other are adjacent to each other. In this implementation manner, the transmission portions 56 are parallel to each other. Each feeding unit 54 is formed by arranged metal through holes 51. In this implementation manner, each transmission portion is formed by four metal through holes arranged in a straight line, the short-circuit end is formed by two metal through holes, and the two metal through holes 51 forming the short-circuit end 58 are connected between one pair of transmission portions 56, thereby forming a substrate-integrated waveguide having a closed end.

A length of the coupling slot 21 is a half of a wavelength of a center frequency of the antenna 100, and a distance between the coupling slot 21 and the short-circuit end 58 is a quarter of the wavelength of the center frequency. Performance of the antenna is related to a frequency. Generally, a frequency at which the antenna has best performance is referred to as a center frequency. When a frequency is deviated from this frequency, no matter the frequency becomes lower or higher, the antenna performance is lowered, a principle of which is that composition structures in the antenna, such as a transmission line, a transmission line conversion structure, and a structure and size of a radiating unit, are related to the signal frequency. When an antenna is designed, a center frequency needs to be set according to an actual requirement, and is used as a design input to design composition parts of the antenna, and in solutions of designing the antenna and the composition parts of the antenna, a solution in which performance is slowly lowered in the case of deviation from the center frequency is considered as far as possible.

The feeding section 52 further includes a T-shaped power splitter 55, where the T-shaped power splitter 55 is located between two adjacent feeding units 54, and is close to open ends 59 of the feeding units 54. The T-shaped power splitter 55 functions to split one channel of signal into two channels. In this implementation manner, each T-shaped power splitter 55 is formed by three metal through holes 51 that are triangularly arranged.

The multiple branches 1124 are symmetrically distributed on two sides of the central area 1122, and the radiating arrays 111 are symmetrically distributed on two sides of the power splitter 112.

The first dielectric layer 40 and the first metal layer 10 form a radiating dielectric substrate of the array antenna 100, the second metal layer 20, the second dielectric layer 50 and the third metal layer 30 together form a feeding dielectric substrate of the array antenna 100, and thicknesses and dielectric constants of the radiating dielectric substrate and the feeding dielectric substrate are different. Because the radiating dielectric substrate and the feeding dielectric substrate are dielectric substrates that are independent of each other, the thickness and the dielectric constant of the radiating dielectric substrate may be selected according to design requirement of feeding and radiation of the array antenna, and the thickness and the dielectric constant of the feeding dielectric substrate may be selected according to a convenience degree of integration with an active circuit. Selection can be performed flexibly, which helps ensure bandwidth and a gain of the array antenna 100.

The radiating dielectric substrate and the feeding dielectric substrate overlap. In an implementation manner of the present invention, the thickness of the radiating dielectric substrate is 0.254 mm, and the thickness of the feeding dielectric substrate is 0.508 mm.

In this implementation manner, the multiple coupling slots 21 are rectangular, the multiple metal through holes 51 are circular, and the multiple radiating arrays 111 are square.

The power splitter 112 is a microstrip splitter, and is of a planar structure, so that the array antenna 100 has a compact structure and a small size.

Figure 6:
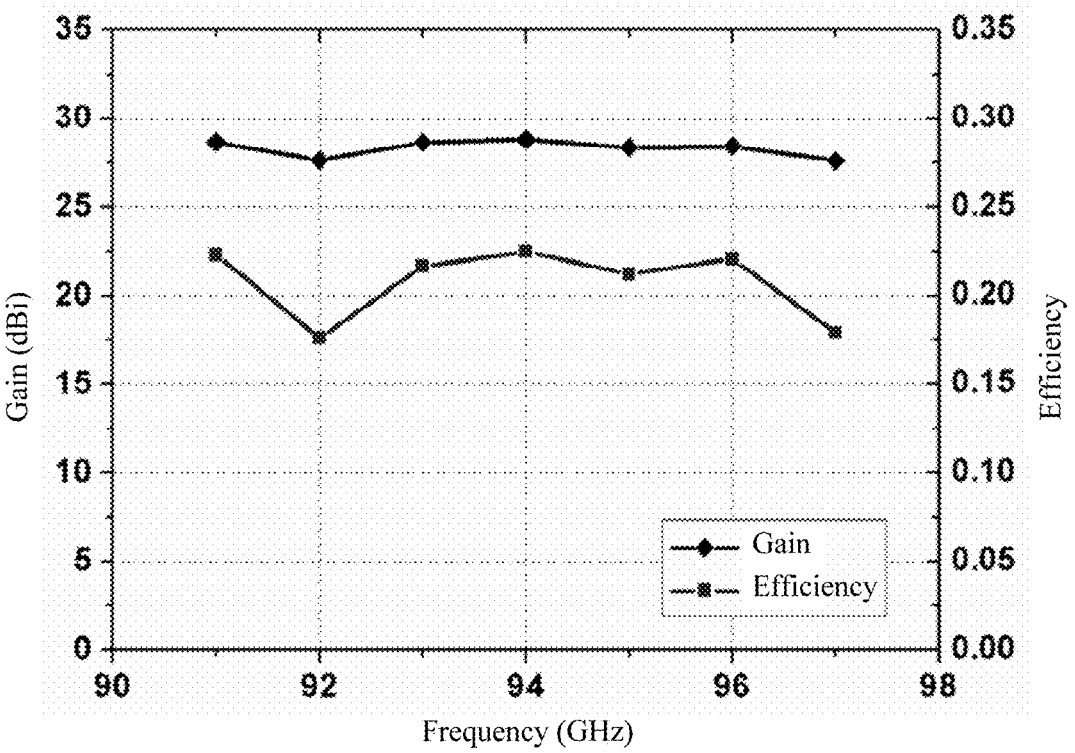
FIG. 6 is a line graph of a relationship between a gain, an efficiency and a frequency of an array antenna according to the present invention.

FIG. 6 is a line graph of a relationship between a gain, an efficiency and a frequency of the array antenna 100 according to the present invention. A frequency of the array antenna 100 is within a range of 90 GHz to 98 GHz, a gain that is achieved is within a range of 27.7 dBi to 28.8 dBi, a relative bandwidth is up to 9.5%, and an efficiency of the array antenna 100 is within a range of 0.18 to 0.22.

Figure 7:
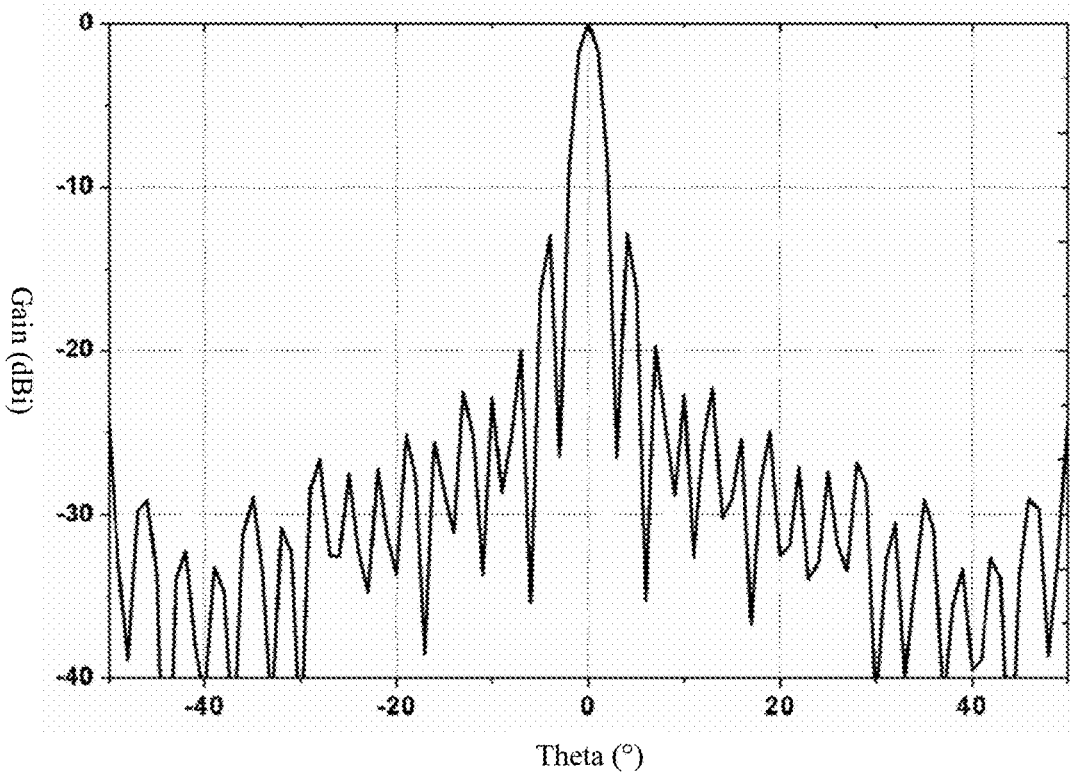
FIG. 7 is a diagram of an emulated radiation direction of an array antenna according to the present invention.

FIG. 7 is a diagram of an emulated radiation direction of an array antenna according to the present invention. It can be known from the figure that the array antenna 100 achieves a high gain and a low side lobe level of −12.8 dB.

An array antenna provided in the embodiments of the present invention is described above in detail. In this specification, specific examples are used to describe the principle and implementation manners of the present invention, and the description of the embodiments is only intended to help understand the method and core idea of the present invention. Meanwhile, a person of ordinary skill in the art may, based on the idea of the present invention, make modifications with respect to the specific implementation manners and the application scope. Therefore, the content of this specification shall not be construed as a limitation to the present invention.

What is claimed is:

1. An array antenna comprising:

a first dielectric layer;

a first metal layer forming multiple subarrays on a first side of the first dielectric layer, each subarray including multiple radiating arrays and one power splitter having a central area and multiple branches extending from the central area, the multiple radiating arrays respectively connected to ends of the multiple branches distant from the central area to form a parallel signal transmission architecture;

a second dielectric layer having multiple metal through holes;

a second metal layer between the second dielectric layer and a second side of the first dielectric layer, opposite the first side of the first dielectric layer, with multiple coupling slots disposed on the second metal layer, each of the multiple coupling slots respectively facing the central area of a corresponding power splitter; and a third metal layer electrically connected by the multiple metal through holes in the second dielectric layer to the second metal layer to form a feeding section to feed a signal to the central area of the power splitter in each of the subarrays via the multiple coupling slots and to the multiple radiating arrays in each of the subarrays via the multiple branches.

2. The array antenna according to claim 1, wherein the feeding section comprises multiple feeding units, and projections of the multiple coupling slots on the second dielectric layer respectively fall within ranges of the multiple feeding units.

3. The array antenna according to claim 2, wherein each of the feeding units is of a mirror symmetric structure, the metal through holes forming the feeding units are symmetrically distributed on two sides of central lines of the feeding units, respectively, and the multiple coupling slots deviate from the central lines of the feeding units, respectively.

4. The array antenna according to claim 2, wherein each of the feeding units comprises a pair of transmission portions, a short-circuit end, and an open end, wherein the short-circuit end is connected between the pair of transmission portions and is located on one end of the pair of transmission portions, the open end is located on one side of the transmission portions that is far from the short-circuit end, each two of the multiple feeding units are opposite to each other, and open ends of the two feeding units that are opposite to each other are adjacent to each other.

5. The array antenna according to claim 4, wherein the transmission portions are parallel to each other.

6. The array antenna according to claim 4, wherein the feeding section further comprises a T-shaped power splitter located between two adjacent feeding units, between the open ends of the two adjacent feeding units.

7. The array antenna according to claim 6, wherein each T-shaped power splitter includes three metal through holes that are triangularly arranged.

8. The array antenna according to claim 1, wherein in each of the subarrays the multiple branches are symmetrically distributed on two sides of the central area, and the radiating arrays are symmetrically distributed on two sides of the power splitter.

9. The array antenna according to claim 1, wherein the first dielectric layer and the first metal layer form a radiating dielectric substrate of the array antenna, wherein the second metal layer, the second dielectric layer and the third metal layer together form a feeding dielectric substrate of the array antenna, and wherein thicknesses and dielectric constants of the radiating dielectric substrate and the feeding dielectric substrate are different.

10. The array antenna according to claim 9, wherein the radiating dielectric substrate and the feeding dielectric substrate overlap, the thickness of the radiating dielectric substrate is 0.254 mm, and the thickness of the feeding dielectric substrate is 0.508 mm.

11. The array antenna according to claim 1, wherein the multiple coupling slots are rectangular, and the multiple metal through holes are circular.

12. The array antenna according to claim 1, wherein the power splitter is a microstrip splitter.

13. The array antenna according to claim 1, wherein the multiple metal through holes run through the second metal layer, the second dielectric layer and the third metal layer.

* * * * *